US007666805B1

(12) United States Patent
Lu

(10) Patent No.: US 7,666,805 B1
(45) Date of Patent: Feb. 23, 2010

(54) SPUNBOND FABRICS AND LAMINATES FROM ULTRA LOW VISCOSITY RESINS

(76) Inventor: Fumin Lu, 7010 NW. 81st St., Tamarac, FL (US) 33321

( * ) Notice: Subject to any disclaimer, the term of this patent is extended or adjusted under 35 U.S.C. 154(b) by 1439 days.

(21) Appl. No.: 09/778,454

(22) Filed: Feb. 7, 2001

(51) Int. Cl.
*D04H 3/00* (2006.01)

(52) U.S. Cl. ..... 442/401; 264/176.1; 264/638

(58) Field of Classification Search ..... 442/401; 264/638, 176.1
See application file for complete search history.

(56) References Cited

U.S. PATENT DOCUMENTS 5,476,911 A * 12/1995 Morini et al. ..... 526/124.6
5,688,468 A * 11/1997 Lu ..... 264/555
6,268,302 B1 * 7/2001 Ofosu et al. ..... 442/407
6,548,431 B1 * 4/2003 Bansal et al. ..... 442/327

FOREIGN PATENT DOCUMENTS

JP 03146756 A * 6/1991
WO WO 9629460 A1 * 9/1996

OTHER PUBLICATIONS

"Spun-bonded products". Complete Textile Glossary, Celanese Acetate, 2001.*

* cited by examiner

*Primary Examiner*—Andrew T Piziali
(74) *Attorney, Agent, or Firm*—Malin Haley DiMaggio Bowen & Lhota, PA

(57) ABSTRACT

This invention relates to a new non-woven fabric or laminate produced in a spunbond process using ultra low polymeric resins above 100 MFR as the raw materials using filament speeds above 5,000 meters per minute. The new materials produced possess an excellent combination of the softness and the strength resulting from ultra fine filaments attained through high spinning speed and the favorable filament structure allowing for strong binding achieved. One spunbond process that can be used for producing the fabric using the ultra low polymeric resins as raw materials is the process described in U.S. Pat. No. 5,688,468 and U.S. Pat. No. 6,183,684 that provides for filament speeds above 5,000 meters per minute.

2 Claims, No Drawings

SPUNBOND FABRICS AND LAMINATES FROM ULTRA LOW VISCOSITY RESINS

BACKGROUND OF THE INVENTION

1. Field of the Invention

The present invention relates generally to a process and the product produced therefrom for constructing spunbond fabrics or laminates using a raw material of ultra low viscosity resins. An apparatus and process for producing such a fabric is to use the spunbond process described in Applicant's U.S. Pat. No. 5,688,468 entitled Process for Producing Non-Woven Webs, issued Nov. 18, 1997, and U.S. Pat. No. 6,183,684, which are hereby incorporated by reference. The process is required to provide filaments from the ultra low viscosity resins with high spinning speed above 4,000 meters per minute.

2. Description of Related Art

The term R.V. shall mean relative viscosity and is a ratio. The term PA6 refers to nylon 6. The unit for melt flow rate is given in grams/10 minutes at 230 degrees Centigrade. The inherent viscosity of the polyester for the present invention is determined in a 0.5 wt. % (percentage) solution in a 60/40 phenol/tetrachloroethane solvent mixture. The determined inherent viscosity is then converted to intrinsic viscosity (I.V.) using an established formula.

It has been known in the prior art that different processes for making fabrics and laminates require different polymeric resins to be used as feedstock or raw materials with certain aspects such as viscosity or molecular weight. The fact that polypropylene (PP) resins with a melt flow rate (MFR) ranging from 25 to 40 are most widely used in the spunbond industry and no PP resins with an MFR over 100 have ever been attempted in the spunbond process is well known. However, high MFR resins up to 1500 have been commercially available for the melt blowing process and hence have been referred to as meltblown grade resins.

It is believed in the prior art that the fabrics produced by the spunbond process possess properties distinctively different from that produced from the melt blown technology in terms of the range of filament size (denier), fabric strength, softness and barrier properties. Therefore, the fabrics produced by spunbond process are used in different products for different applications from the products produced by the melt blown technology.

At some point the "SMS" (Spunbond/Meltblown/Spunbond) technology was then created to produce "SMS" composite laminated fabrics where the "S" layer serves the role of support with tenacity and the "M" layer serves the role of improving the appearance and the barrier properties of the composite with its ultra fine filaments. It is well known that there are drawbacks of the "SMS" composites, such that while the barrier property is improved, the composite fabric looses its softness and breathability because of the "M" layer acting like a layer of glue. The "SMS" composite is very susceptible of being damaged when stretched during converting due to the brittleness of "M" layer resulting in the barrier property being destroyed.

Applicant has determined that ultra low viscosity resins with a melt flow rate over 100 can be used successfully for improved spunbond fabrics and laminates with a process able to spin filaments at high speed of above 4,000 meters per minute.

BRIEF SUMMARY OF THE INVENTION

This invention relates to a new non-woven fabric or laminate produced in a spunbond process such as that disclosed in Applicant's U.S. Pat. No. 5,688,468 and U.S. Pat. No. 6,183,684, incorporated herein by reference, that employs as raw material ultra low viscosity polymeric resins for polypropylene (PP) with an MFR over 100 and polyethylene terephthalare (PET) resins with I.V. (intrinsic viscosity) less than 0.55 or other fiber forming polymers with viscosity lower than that of fiber grade resins that are generally low molecular weight and low crystallinity materials. Thus, the resulting resins with ultra low viscosity can be processed at lower temperature and the filaments can be spun at higher velocity than that of the resins with a high viscosity (low MFR), resulting in filaments of finer diameters produced (as low as 0.2 dpf or lower). Even though the filament tenacity is normally lower with lower viscosity resins, the strength of fabric produced can be compensated by the bonding strength due to the fact that bonding only occurs in the amorphous phase of the filaments which is in favor of the lower viscosity resins.

The fabric or laminates produced in the spunbond process in accordance with this invention using ultra low viscosity resins can be a single layer of "S" or multiple layers of "SS" or "SMS" and so on and so forth, with each layer having different characteristics in terms of filament size and basis weight.

It is an object of this invention to provide a new non-woven fabric or laminate produced in a spunbond process that uses ultra low polymeric resins as the raw materials utilizing a spunbond process as described in U.S. Pat. No. 5,688,468 and U.S. Pat. No. 6,184,183 using high filament speeds above 4,000 M/min.

It is another object of the invention to provide improved spunbond fabrics and laminates produced with ultra low viscosity resins such as PP with MFR over 100, PET resins with an I.V. (intrinsic viscosity) of less than 0.55, and polyamide (PA6) of R.V. below 2.2 and polyethylene (PE) with MFR over 50 in the form of either mono or multi-component filaments in a spunbond process using high filament speeds above 4,000 M/min.

In accordance with these and other objects which will become apparent hereinafter, the instant invention will now be described with particular reference to the accompanying drawings.

DETAILED DESCRIPTION OF THE INVENTION

A spunbond fabric or laminate that utilizes ultra low polymeric resins as a raw material can be manufactured and produced with an apparatus and process such as described in U.S. Pat. No. 5,688,468 and U.S. Pat. No. 6,183,684 that provides high filament speeds. The ultra low viscosity polymer resins could be PP resins with a MFR over 100 in one example.

In another embodiment the raw material can be PET resins with an intrinsic viscosity of less than 0.55. In yet another embodiment other fiber forming polymers with viscosities lower than that of regular fiber grade resins could be used.

A fabric or laminate produced in a process using the ultra viscosity resins could be a single layer of "S" or multiple layers of "SS", or "SMS" and so on, and the layers can have different characteristics in term of filaments size and basis weight.

Example 1

A commercial polypropylene resin of 350 MFR supplied by ATOFINA Oil and Chemical Company was used as a raw material in a high filament velocity spunbond process as described in U.S. Pat. No. 5,688,468 and U.S. Pat. No. 6,183,684. A fabric of approximately 600 mm wide with average filament diameter of eight (8) microns (about 0.4 denier per filament) was produced at throughput of 0.3 ghm (gram per hole per minute) and melt temperature of 215 C. Under this processing condition, 15 gsm (gram per square meter) fabric was produced at line speed of 80 meters per minute. The filament spinning speed reached in this case is 6,750 M/min and the fabric thus produced has very soft hand and yet strong with MD tenacity of 54 mN/tex and elongation to break of 58% (ASTM D1117-80). In addition, it possesses a unique combination of excellent barrier property and air permeability. The fabric has hydrostatic head tested by INDA method of 207 mm with the air permeability of 292 ft3/ft2/min. The properties mentioned above are far superior to what the process can accomplish using regular spunbond PP resins with MFR below 100.

Example 2

Same raw material and equipment were used as in Example 1. The process condition was also kept the same except that the line speed goes up to 110 M/min. The fabric thus produced has basis weight of 11 ghm. The fabric is extremely soft and has a MD tenacity of 50 mN/tex and 54% elongation to break. The hydrostatic head and air permeability is 150 mm and 467 ft3/ft2/min., respectively. The hydrostatic head of this fabric is equivalent to that of a 15 gsm fabric produced under the similar process condition but with a regular PP resin of 35 MFR.

Example 3

A commercial polypropylene resin of 750 MFR supplied by ATOFINA Oil and Chemical Company was used as a raw material in a spunbond process as in Example 1. The resin was spun at melt temperature of 180 C with throughput of 0.25 ghm. A fabric of 17 gsm with filaments of 0.37 dpf (denier per filament) was produced at line speed of 60 M/min. The fabric has extreme soft hand and possesses barrier property of 200 mm and air permeability of 305 fr3/fr2/min. The filament speed reached is 6,000 m/min.

Example 4

Eastman Chemical Company supplied a PET resin with low I.V. of 0.53. The resin was dried at 140 C for 6 hours before being processed with the system as in Example 1. The melt temperature was kept at 285 C. Throughput of 1.0 and 0.5 ghm was used. The filaments produced have diameter of 11.5 and 7.5 microns, respectively. The filament spinning speed reached is 6,900 and 6,500 M/min.

The filaments used can be mono-component (one material) or multiple components that are made up of two or more different resins or the same resin with different viscosities weights.

The following is a comparison of the new spunbond ultra low viscosity resin fabrics and laminates with prior art spunbond fabrics or SMS.

| PROPERTY | NEW MATERIAL (S, SS . . . ) | PRIOR SPUNBOND | PRIOR SMS |
|---|---|---|---|
| Fabric strength: | Medium | High | Medium |
| Softness: | Excellent | Medium | Poor |
| Consistency in Property Between Layers: | Excellent | Excellent | Poor |

A garment such as a surgical gown could be made of this fabric or laminate and have excellent water/liquid barrier properties required for protection against blood penetration, while having good air permeability. The filaments of 0.6 denier and below have been produced and filament speeds well above 6,000 M/min reached. The resin melt flow rate of well over 100 for polypropylene can be used.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A spunbond fabric having excellent softness and strength, made from the spunbond process, including:

(a) extruding filaments consisting of an ultra low viscosity polypropylene polymeric resin having a melt flow rate in grams/10 minutes at 230 degrees Centigrade between 350 MFR and 750 MFR from a spinneret;

(b) drawing said filaments through a drawing unit;

(c) generating a filament speed above 4,000 meters per minute; and (d) creating a fabric consisting of one or more layers of filaments extruded using the same melt flow rate resins between 350 and 750.

2. A spunbond fabric having excellent softness, strength, barrier properties, and air breathability made from a spunbond process, including the steps of:

(a) extruding filaments consisting of polyamide (PA6 nylon 6) of a R.V. (relative viscosity) below 2.2 from a spinneret;

(b) drawing said filaments through a drawing unit;

(c) generating a filament speed above 4,000 meters per minute; and (d) forming a fabric consisting of one or more layers of similar filaments having a R.V. below 2.2 drawn from said unit.

* * * * *